US006809615B2

(12) United States Patent
Sonoda et al.

(10) Patent No.: US 6,809,615 B2
(45) Date of Patent: Oct. 26, 2004

(54) BAND-PASS FILTER AND COMMUNICATION APPARATUS

(75) Inventors: Tomiya Sonoda, Yokohama (JP); Toshiro Hiratsuka, Machida (JP); Yutaka Sasaki, Yokohama (JP); Kiyoshi Kanagawa, Yokohama (JP); Keiichi Hirose, Sagamihara (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 10/118,199

(22) Filed: Apr. 5, 2002

(65) Prior Publication Data

US 2002/0163404 A1 Nov. 7, 2002

(30) Foreign Application Priority Data

May 2, 2001 (JP) ..... 2001-134863

(51) Int. Cl.[7] ..... H01P 1/20
(52) U.S. Cl. ..... 333/202; 333/208
(58) Field of Search ..... 333/202–205, 333/208, 209, 24 C

(56) References Cited

U.S. PATENT DOCUMENTS

| | | | | |
|---|---|---|---|---|
| 3,760,304 A | | 9/1973 | Cohn | |
| 6,166,612 A | * | 12/2000 | Tsujiguchi | 333/204 |
| 6,184,758 B1 | | 2/2001 | Ishikawa et al. | |
| 6,535,078 B1 | * | 3/2003 | Okada et al. | 333/134 |

FOREIGN PATENT DOCUMENTS

| | | |
|---|---|---|
| EP | 0 301 789 A1 | 2/1989 |
| EP | 0 933 831 A1 | 8/1999 |
| EP | 0 948 077 A2 | 10/1999 |
| EP | 0 952 623 A2 | 10/1999 |
| EP | 0 966 055 A1 | 12/1999 |
| JP | 11-4108 | 1/1999 |
| JP | 11-41002 | 2/1999 |
| JP | 11-346102 | 12/1999 |
| JP | 2000-13106 | 1/2000 |
| JP | 2000-31703 | 1/2000 |
| JP | 2000-340171 | 12/2000 |

OTHER PUBLICATIONS

Moraud et al., A New Planar Type Dielectric Resonator for Microwave Filtering, IEEE MTT–S Digest, vol. 3, pp. 1307–1310 (1998).

* cited by examiner

*Primary Examiner*—Kenneth B. Wells
(74) *Attorney, Agent, or Firm*—Dickstein, Shapiro, Morin & Oshinsky, LLP

(57) ABSTRACT

A band-pass filter includes electrodes formed on both upper and lower surfaces of a dielectric plate, and a plurality of non-electrode portions on the upper and lower surfaces of the dielectric plate so that the non-electrode portions face each other across the dielectric plate to form resonators in regions confined by the non-electrode portions on the dielectric plate. The resonators other than at least input- and output-stage resonators are nλ2 resonators, where λ denotes one wavelength and n is an integer more than one. The first- and second-stage resonators, and the third- and fourth-stage resonators are magnetically (inductively) coupled, and the second- and third-stage resonators are capacitively or inductively coupled. The band-pass filter therefore provides satisfactory attenuation characteristic from the pass band to the stop band, and can also be compact and lightweight.

6 Claims, 7 Drawing Sheets d/L > 2/3 ELECTRIC (CAPACITIVE) COUPLING d/L < 2/3 MAGNETIC (INDUCTIVE) COUPLING

BAND-PASS FILTER AND COMMUNICATION APPARATUS

BACKGROUND OF THE INVENTION

1. Field of the Invention

The present invention relates to a band-pass filter including a plurality of resonators formed on a dielectric plate, and a shared transmitting-and-receiving unit and a communication apparatus using the band-pass filter.

2. Description of the Related Art

One typical planar-circuit dielectric filter is a dielectric filter with attenuation poles at a low- or high-frequency region or both regions of the pass band, as disclosed in Japanese Unexamined Patent Application Publication No. 2000-13106, in which, for coupling resonators that are spaced at least one stage apart from each other, polarization coupling lines are formed on an input/output substrate or a cover which is a portion of a cavity, or otherwise, polarization coupling lines are formed on the upper and lower surfaces of a dielectric plate which is a filter substrate.

FIG. 19 illustrates the structure of a dielectric plate which is a typical filter substrate in the dielectric filter disclosed in the above publication. In FIG. 19, electrodes are formed over both surfaces of a rectangular dielectric plate. There are non-electrode portions 4*a* to 4*e* on the upper surface of the dielectric plate. There are also non-electrode portions having the same configuration as that of the non-electrode portions 4*a* to 4*e* formed on the lower surface of the dielectric plate so as to face the non-electrode portions 4*a* to 4*e*. The dielectric portions which are sandwiched between the non-electrode portions formed on the upper and lower surfaces of the dielectric plate serve as resonators. Accordingly, in the example shown in FIG. 19, the non-electrode portions or electrode-free portions 4*a* and 4*e* serve as input- and output-stage resonators, and the non-electrode portions or electrode-free portions 4*b*, 4*c*, and 4*d* serve as three resonator stages therebetween. A band-pass filter formed of a total of five resonator stages is thus constructed.

In order to produce an attenuation pole, a polarization line may be formed on a plate different from the dielectric plate shown in FIG. 19. This plate may be adjacent to the dielectric plate, and the second- and fourth-stage resonators may be magnetically cross-coupled, thereby producing an attenuation pole.

Meanwhile, as demand has increased for more compact, lightweight, and sophisticated electronic devices using such a planar-circuit dielectric filter, such as cellular telephones in particular, the dielectric filter is also required to be more compact and lightweight.

In the example shown in FIG. 19, the dielectric plate has an outer dimension of 18×4.8 mm (86.4 $mm^2$) where the relative dielectric constant of the dielectric plate is 24 and the center frequency of the pass band is 26.5 GHz. A need still exists for a more compact dielectric plate.

Furthermore, the number of stages of resonators must increase in order to achieve a sharp attenuation characteristic from the pass band to the stop band; this leads to a problem of increased size of the overall device.

A polarization coupling line which is formed in order to produce an attenuation pole may also lead to another problem of conductor loss due to the coupling line, resulting in low Q factor while increasing insertion loss. A separate provision of a substrate which carries a polarization coupling line may also lead to another problem in that any relative misalignment between this substrate and the dielectric plate which is a filter substrate would cause variations in the frequency of the attenuation pole to make the attenuation characteristic unstable, thereby requiring a strategy to overcome this problem.

SUMMARY OF THE INVENTION

Accordingly, it is an object of the present invention to provide a compact and lightweight band-pass filter which provides a satisfactory attenuation characteristic from the pass band to the stop band, and a shared transmitting-and-receiving unit and a communication apparatus using the band-pass filter.

To this end, in one aspect of the present invention, a band-pass filter comprising a dielectric filter includes electrodes formed on both upper and lower surfaces of a substantially rectangular dielectric plate, and a plurality of sets of substantially rectangular non-electrode portions which are adjacent to each other, each set of non-electrode portions facing across the dielectric plate, forming resonators in regions confined by the non-electrode portions on the dielectric plate. The resonators other than at least input- and output-stage resonators are $n\lambda/2$ resonators, where $\lambda$ denotes one wavelength and n is an integer more than one, including a group of adjacent resonators which are capacitively coupled, and a group of adjacent resonators which are inductively coupled.

The direction in which the non-electrode portions are aligned differs depending upon whether resonators formed in the portions confined by non-electrode portions on the dielectric plate are capacitively or inductively coupled. The presence of a group of adjacent resonators which are capacitively coupled, and a group of adjacent resonators which are inductively coupled allows the non-electrode portions to be arranged, for example, in a staggered fashion rather than linearly, thereby reducing the rectangular dielectric plate in size in its longitudinal direction. The overall band-pass filter can be therefore more compact and lightweight.

The input-stage resonator may be inductively coupled with the resonator adjacent thereto, and the output-stage resonator may be inductively coupled with the resonator adjacent thereto. The resonators other than the input- and output-stage resonators may be capacitively coupled with each other.

Conversely, the input-stage resonator may be capacitively coupled with the resonator adjacent thereto, and the output-stage resonator may be capacitively coupled with the resonator adjacent thereto. The resonators other than the input- and output-stage resonators may be inductively coupled with each other.

With this structure, the direction in which the input- and output-stage resonators are aligned differs from the direction in which the remaining resonators are aligned, thereby reducing the dielectric plate in size in its longitudinal direction. This structure also provides cross-coupling every other resonator between the input- and output-stage resonators, and the resonators other than the input- and output-stage resonators which are coupled with each other, resulting in polarization.

The resonators other than the input- and output-stage resonators may be $\lambda$ resonators, where $\lambda$ denotes one wavelength, and may be arranged so that the longitudinal axes of the resonators are parallel to each other rather than linearly aligned. These resonators may be capacitively coupled with each other when d/L is greater than approximately 0.67, where L denotes the length of the resonators in the longitudinal direction, and d denotes the length of facing portions of adjacent resonators in the resonators.

Conversely, these resonators may be inductively coupled with each other when d/L is smaller than approximately 0.67.

Therefore, a band-pass filter can be constructed merely by defining a relationship between the length L of the resonators in the longitudinal direction and the length d of the facing portions of adjacent resonators, that is, with simplification in design.

In another aspect of the present invention, a band-pass filter comprising a dielectric filter includes electrodes formed on both upper and lower surfaces of a substantially rectangular dielectric plate, and a plurality of sets of substantially rectangular non-electrode portions, each set of non-electrode portions facing across the dielectric plate, forming resonators in regions confined by the non-electrode portions on the dielectric plate. The resonators are arranged so that the electric fields for the resonance mode used by the resonators are oriented in the same direction, and adjacent resonators in the resonators are shifted by a predetermined value in a parallel manner to the orientation of the magnetic fields.

Therefore, adjacent resonators can be electrically coupled, while resonators can be magnetically cross-coupled every other resonator, thereby achieving polarization.

In another aspect of the present invention, a band-pass filter comprising a dielectric filter includes electrodes formed on both upper and lower surfaces of a substantially rectangular dielectric plate, and a plurality of sets of substantially rectangular non-electrode portions, each set of non-electrode portions facing across the dielectric plate, forming resonators in regions confined by the non-electrode portions on the dielectric plate. The resonators are arranged so that the electric fields for the resonance mode used by the resonators are oriented in the same direction, adjacent resonators in the resonators are shifted by a predetermined value in a parallel manner to the orientation of the magnetic fields, and the longitudinal axes of the resonators are not parallel and at an angle with respect to the longitudinal and widthwise axes of the dielectric plate.

This structure allows the dielectric plate to be reduced in size in its widthwise direction.

In another aspect of the present invention, a band-pass filter comprising a dielectric filter includes electrodes formed on both upper and lower surfaces of a substantially rectangular dielectric plate, and a plurality of sets of non-electrode portions, each set of non-electrode portions facing across the dielectric plate, forming resonators in regions confined by the non-electrode portions on the dielectric plate. The resonators other than at least input- and output-stage resonators are dual-mode resonators which resonate in a mode for which an electric field is oriented in the direction of alignment of the resonators, and in a mode for which an electric field is oriented in the direction vertical (perpendicular) thereto, and adjacent dual-mode resonators are capacitively and inductively coupled with each other.

This allows a great number of stages of resonators to be formed on a restricted area of the dielectric plate, and coupling of dual-mode resonators allows for cross-coupling every two resonators.

In a further aspect of the present invention, a shared transmitting-and-receiving unit includes any of the above-described band-pass filters as a transmission filter and a reception filter. The shared transmitting-and-receiving unit can therefore be compact and lightweight.

In a still further aspect of the present invention, a communication apparatus includes any of the above-described band-pass filters or shared transmitting-and-receiving unit. The communication apparatus can therefore be compact and lightweight.

Other features and advantages of the present invention will become apparent from the following description of embodiments of the invention which refers to the accompanying drawings.

BRIEF DESCRIPTION OF THE DRAWINGS

For the purposes of illustrating the invention, there is shown in the drawings a form which is presently preferred, it being understood however, that the invention is not limited to the precise form shown by the drawings in which.

DESCRIPTION OF EMBODIMENTS OF THE INVENTION

A band-pass filter according to a first embodiment of the present invention is now described with reference to FIGS. 1 to 5.

Figure 1:
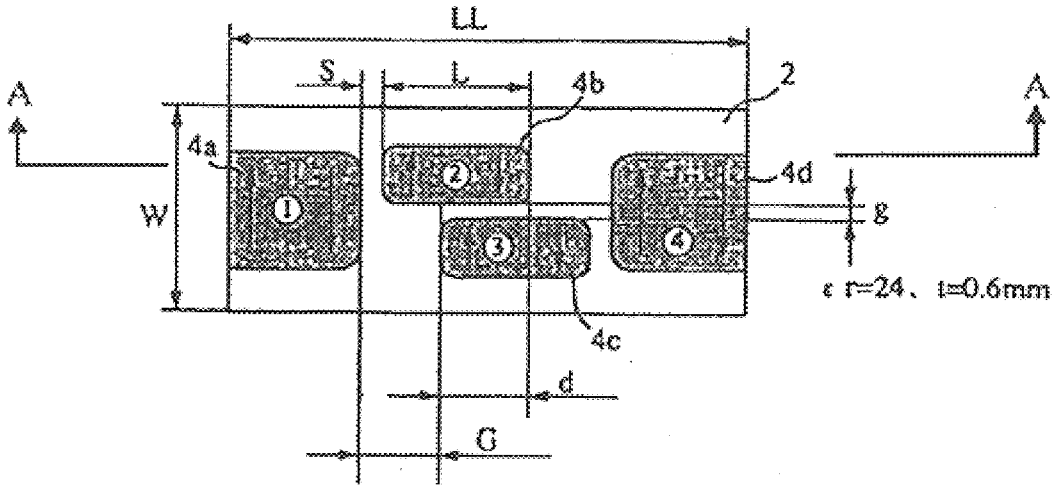
FIG. 1 is a top plan view of a dielectric plate in a band-pass filter according to a first embodiment of the present invention.
Figure 2:
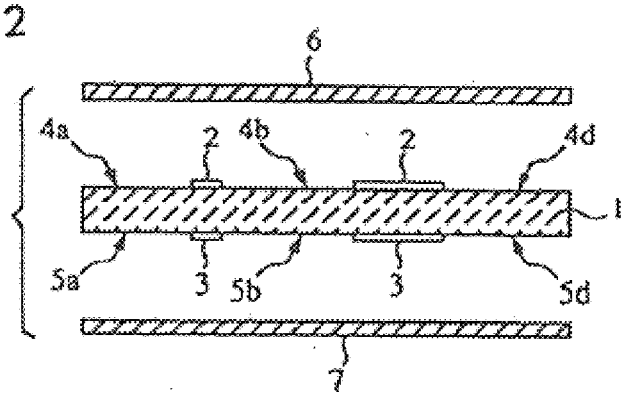
FIG. 2 is a cross-sectional view of the main portion of the band-pass filter along line A—A of FIG. 1.

FIG. 1 is a top plan view of the structure of a dielectric plate which is a filter substrate of the band-pass dielectric filter, and FIG. 2 is a cross-sectional view of the main portion of the band-pass filter.

As shown in FIGS. 1 and 2, an electrode 2 including non-electrode portions 4*a*, 4*b*, 4*c*, and 4*d* at predetermined positions is formed over the upper surface of a rectangular dielectric plate 1. An electrode 3 incorporating non-electrode portions 5*a* to 5*d* which face the non-electrode portions 4*a* to 4*d* on the upper surface is formed on the lower surface of the dielectric plate 1. A conductive plate 6 faces a conductive plate 7 at a predetermined spacing so as to enclose the dielectric plate 1 therebetween.

In FIG. 1, arrows in the non-electrode portions 4*a* to 4*d* indicate the direction of the electric fields generated by first- to fourth-stage resonators as indicated by (1) to (4) in FIG. 1. The first- and fourth-stage resonators function as (¾)λ resonators with one end open, where λ denotes one wavelength at the frequency of use of the dielectric plate. The second- and third-stage resonators function as λ resonators. The first- and second-stage resonators are magnetically (inductively) coupled, and the third- and fourth-stage resonators are magnetically (inductively) coupled. The second- and third-stage resonators are electrically (capacitively) or magnetically (inductively) coupled, as will be described just as below.

Figure 3:
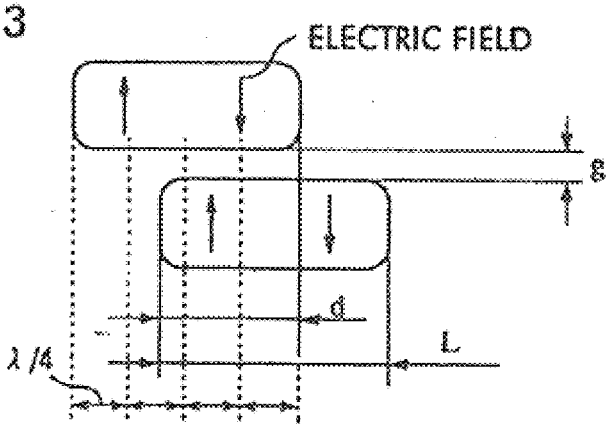
FIG. 3 is a view showing a position relationship between resonators other than the input- and output-stage resonators.
Figure 4:
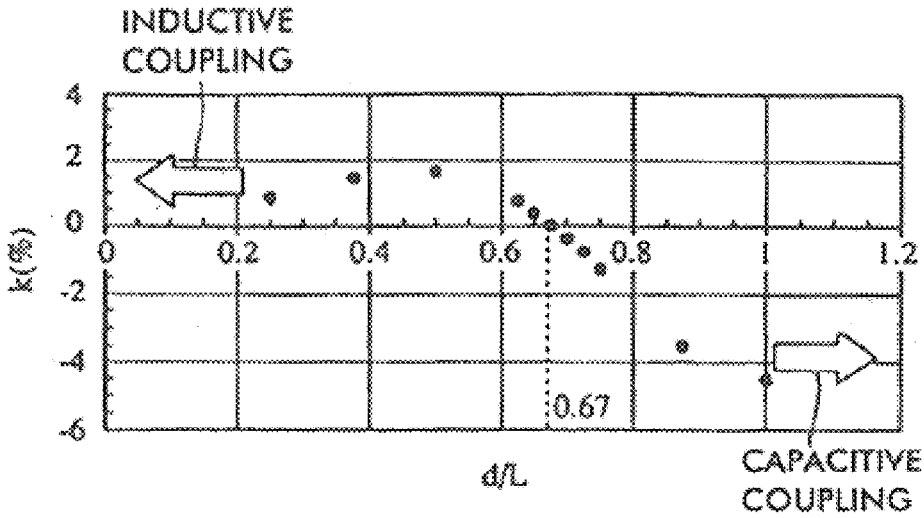
FIG. 4 is a graph showing a change in coupling coefficient k between resonators when the d/L ratio in FIG. 3 varies.

FIG. 3 shows the second- and third-stage resonators with respect to the dimension and position relationship of the non-electrode portions 4*b* and 4*c*. The length of a resonator in its longitudinal direction is indicated by L, and the length of the facing portions of adjacent resonators is indicated by d. FIG. 4 shows a change in coupling coefficient k between the resonators as d/L varies. In this example, gap g between the adjacent resonators is 0.4 mm. It is anticipated that the resonators are inductively coupled if $d/L<0.67$, and are capacitively coupled if $d/L>0.67$.

In the band-pass filter including four resonator stages as shown in FIG. 1, coupling coefficient k12 between the first- and second-stage resonators, and coupling coefficient k34 between the third- and fourth-stage resonators are inductive coupling coefficients. Coupling coefficient k13 between the first- and third-stage resonators, and coupling coefficient k24 between the second- and fourth-stage resonators are inductive cross-coupling coefficients. If coupling coefficient k23 between the second- and third-stage resonators is inductive, inductive cross-coupling is produced between the first- and third-stage resonators with the second-stage resonator being skipped, where the first- and second-stage resonators, and the second- and third-stage resonators are inductively coupled. Furthermore, inductive cross-coupling is produced between the second- and fourth-stage resonators with the third-stage resonator being skipped, where the second- and third-stage resonators, and the third- and fourth-stage resonators are inductively coupled. This results in an attenuation pole at a high-frequency region of the pass band.

If the coupling coefficient k23 is capacitive, conversely, an attenuation pole occurs at a low-frequency region of the pass band.

As shown in FIG. 1, the input- and output-stage resonators are (¾)λ resonators, and the second- and third-stage resonators are positioned so that they face each other in part in the longitudinal direction. Then, the dielectric plate has a dimension LL×W of 11.12×4 mm (44 $mm^2$), and can be reduced in area to approximately 50% of the area of the typical dielectric plate shown in FIG. 19.

Figure 5:
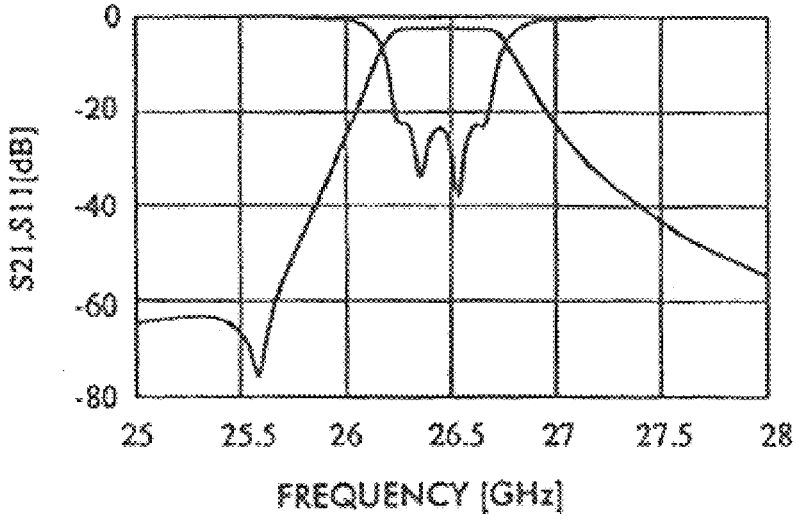
FIG. 5 is a graph showing the frequency characteristic of the band-pass filter shown in FIG. 1.

FIG. 5 shows an example in which the frequency characteristic of the band-pass filter incorporating the dielectric plate shown in FIG. 1 is simulated. In this example, the second- and third-stage resonators are capacitively coupled to produce an attenuation pole at a low-frequency region of the pass band. The circuit constant requirements are as follows:

center frequency: f0=26.455 GHz ripple: 0.01 dB designed bandwidth: BW=430 MHz external Q: Qe=60.8 k12=k34=1.27% k23=−0.93% k13=k24=0.17% unloaded Q for the even mode: Qoe=800 unloaded Q for the odd mode: Qoo=600

In order to meet these circuit constants, the dimensions of the components shown in FIG. 1 should be defined as follows:

g=0.4 mm d/L=0.72 (L=3.37 mm)

S=0.45 mm where the dielectric plate has a relative dielectric constant $\epsilon r$ of 24, and a thickness t of 0.6 mm.

If d/L=0.59, k23=+0.93% (inductive), resulting in an attenuation pole at a high-frequency region of the pass band.

Figure 19:
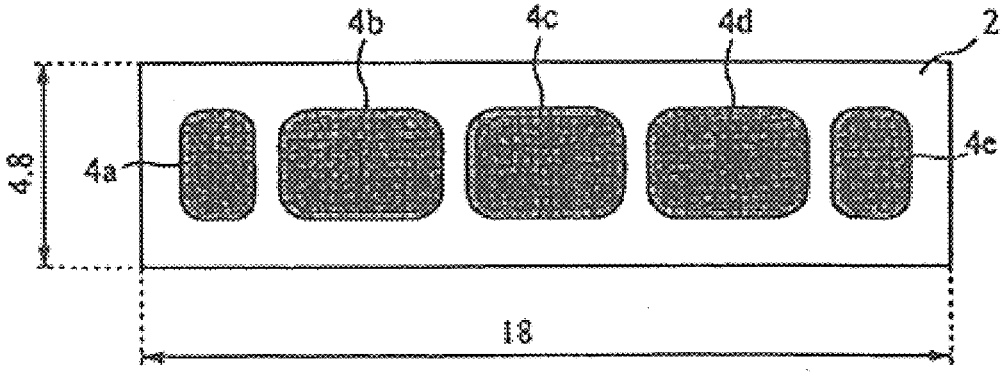
FIG. 19 PRIOR ART
FIG. 19 is a top plan view of a dielectric plate in a typical band-pass filter.

If the input- and output-stage resonators are λ/4 resonators (resonator length=1.02 mm), the dimension LL of the dielectric plate in its longitudinal direction will be approximately 8 mm, and can be thus reduced to 65% of the length of the typical dielectric plate shown in FIG. 19. In addition, with an attenuation pole, the same electric characteristic as that of the typical band-pass filter having five resonator stages as shown in FIG. 19 can be achieved.

The input- and output-stage resonators (1) and (4) shown in FIG. 1 may generally be (2n−1)λ/4 resonators, where n is an integer more than one. The resonators (2) and (3) may generally be nλ/2 resonators, where n is an integer more than one. However, a relationship in which the resonators are inductively coupled for $d/L<0.67$ and capacitively coupled for $d/L>0.67$ is established as long as the resonators (2) and (3) are λ resonators.

Next, a band-pass filter according to a second embodiment of the present invention is described with reference to FIG. 6.

Figure 6:
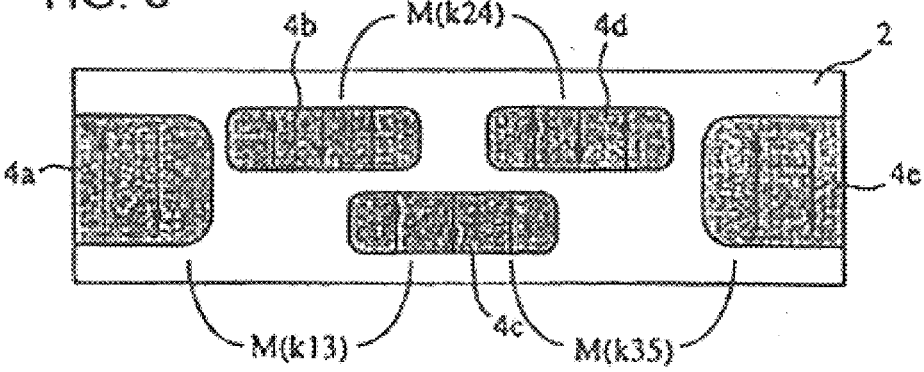
FIG. 6 is a top plan view of a dielectric plate in a band-pass filter according to a second embodiment of the present invention.

FIG. 6 is a top plan view of a dielectric plate in the band-pass filter. In the second embodiment, an electrode 2 including five non-electrode portions 4*a* to 4*e* is formed on the upper surface of the dielectric plate.

The non-electrode portions 4*a* to 4*e* serve as first- to fifth-stage resonators, respectively. The first- and second-stage resonators, and the fourth- and fifth-stage resonators are magnetically (inductively) coupled. In the same relationship as shown in FIG. 3, the second- and third-stage resonators, and the third- and fourth-stage resonators are magnetically (inductively) or electrically (capacitively) coupled. The first- and third-stage resonators, and the third- and fifth-stage resonators are magnetically (inductively) coupled. Thus, if the coupling coefficients k23 and k34 are magnetic (inductive), the cross-couplings are generated at k13 and k35, resulting in two attenuation poles at a high-frequency region of the pass band. If the coupling coefficients k23 and k34 are electric (capacitive), conversely, the cross-couplings are generated at k13 and k35, resulting in two attenuation poles at a low-frequency region of the pass band. Alternatively, if one of the coupling coefficients k23 and k34 is inductive, and the other is capacitive, attenuation poles can be produced at both high- and low-frequency regions of the pass band.

The input- and output-stage resonators shown in FIG. 6 may be $(2n-1)\lambda/4$ resonators, where n is an integer more than one. The remaining resonators may be $n\lambda/2$ resonators, where n is an integer more than one.

Figure 7:
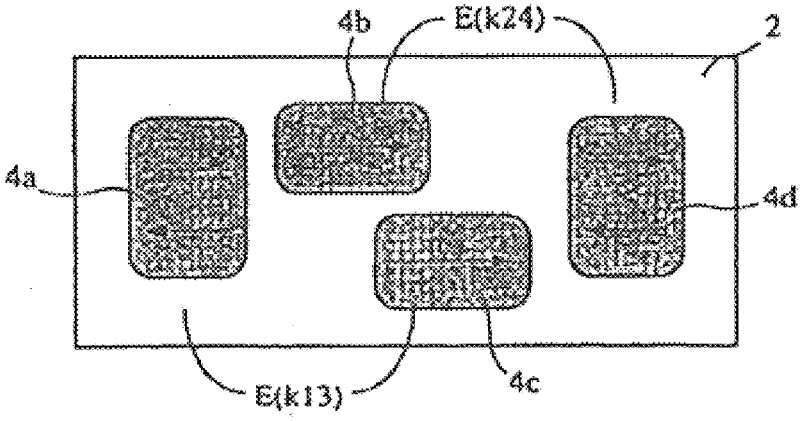
FIG. 7 is a top plan view of a dielectric plate in a band-pass filter according to a third embodiment of the present invention.

Next, a band-pass filter according to a third embodiment of the present invention is described with reference to FIG. 7. FIG. 7 is a top plan view of a dielectric plate in the band-pass filter. In the third embodiment, an electrode 2 including non-electrode portions 4*a* to 4*d* at predetermined positions is formed on the upper surface of the dielectric plate. An electrode including non-electrode portions in position so as to face the non-electrode portions 4*a* to 4*d* is formed on the lower surface of the dielectric plate. In the third embodiment, the first- and second-stage resonators, and the third- and fourth-stage resonators are electrically (capacitively) coupled. The second- and third-stage resonators are magnetically (inductively) or electrically (capacitively) coupled. The first- and third-stage resonators, and the second- and fourth-stage resonators are electrically (capacitively) coupled. Arrows in the non-electrode portions 4*a* to 4*d* indicate the direction of the electric fields generated by the resonators.

The non-electrode portions 4*a* to 4*d* form first- to fourth-stage resonators, respectively. In this retard, coupling coefficient k12 between the first- and second-stage resonators, and coupling coefficient k34 between the third- and fourth-stage resonators are capacitive coupling coefficients. Coupling coefficient k13 between the first- and third-stage resonators, and coupling coefficient k24 between the second- and fourth-stage resonators are capacitive cross-coupling coefficients. If coupling coefficient k23 between the second- and third-stage resonators is capacitive, capacitive cross-coupling is produced between the first- and third-stage resonators with the second-stage resonator being skipped, where the first- and third-stage resonators, and the second- and third-stage resonators are capacitively coupled. Furthermore, capacitive cross-coupling is produced between the second- and fourth-stage resonators with the third-stage resonator being skipped, where the second- and third-stage resonators, and the third- and fourth-stage resonators are capacitively coupled. This causes an attenuation pole at a low-frequency region of the pass band.

If the coupling coefficient k23 is inductive, conversely, an attenuation pole occurs at a high-frequency region of the pass band.

Next, a band-pass filter according to a fourth embodiment of the present invention is described with reference to FIG. 8.

Figure 8:
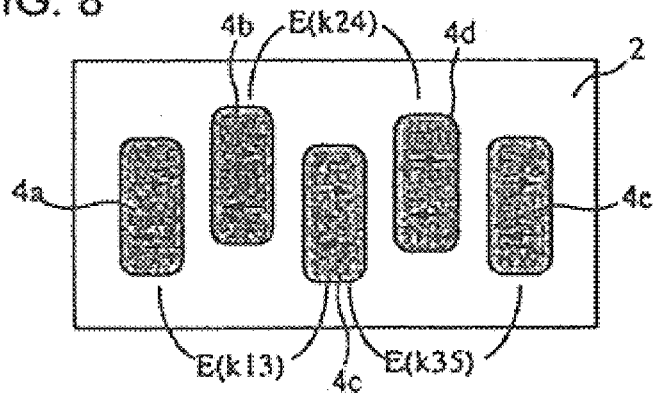
FIG. 8 is a top plan view of a dielectric plate in a band-pass filter according to a fourth embodiment of the present invention.

FIG. 8 is a top plan view of a dielectric plate in the band-pass filter. In the fourth embodiment, resonators formed by non-electrode portions 4*a* to 4*e* are $\lambda$ resonators which are all positioned in parallel, transversely to the longitudinal direction. This allows the electric fields generated by the resonators to be oriented in the same direction, as indicated by arrows in FIG. 8. The resonators are arranged so that adjacent resonators are shifted by a predetermined value in a parallel manner to the orientation of the magnetic fields. This arrangement allows adjacent resonators to be electrically (capacitively) coupled, and allows non-adjacent resonators at the first and third stages, at the third and fifth stages, and at the second and fourth stages to be electrically (capacitively) coupled. In this way, resonators each being capacitively coupled with the previous and next resonators are capacitively cross-coupled every other resonator, resulting in an attenuation pole at a low-frequency region of the pass band.

The resonators may be $n\lambda/2$ resonators, where n is an integer more than one.

Next, a band-pass filter according to a fifth embodiment of the present invention is described with reference to FIGS. 9A and 9B.

Figure 9A:
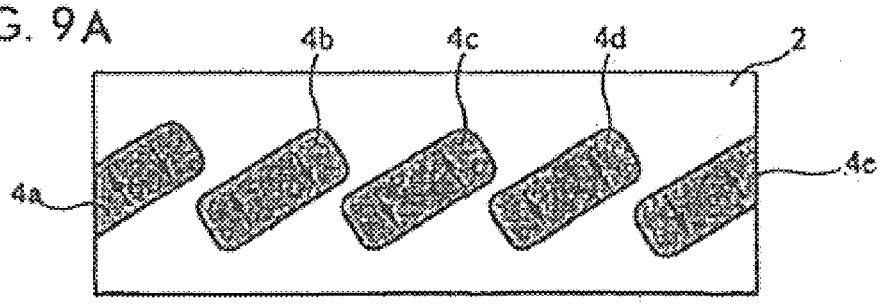
FIGS. 9A and 9B are top plan views of a dielectric plate in a band-pass filter according to a fifth embodiment of the present invention.
Figure 9B:
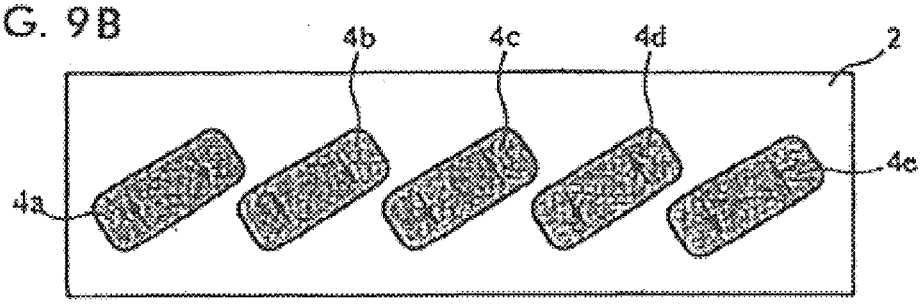

FIGS. 9A and 9B are top plan views of two examples of a dielectric plate in the band-pass filter. In FIGS. 9A and 9B, resonators formed by non-electrode portions 4*a* to 4*e* are arranged so that the electric fields generated by the resonators are oriented in the same direction and adjacent resonators are shifted by a predetermined value in the direction parallel to the magnetic fields, and the longitudinal axes of the resonators are not parallel (are at an angle) with respect to the longitudinal and widthwise axes of the dielectric plate. In the same relationship as shown in FIG. 3, adjacent resonators are electrically (capacitively) or magnetically (inductively) coupled. In FIG. 9A, the input- and output-stage resonators are $(3/4)\lambda$ resonators. In FIG. 9B, all of the resonators are $\lambda$ resonators.

Accordingly, the dielectric plate incorporating resonators which are arranged at an angle can be reduced in area by approximately 20 to 30% as compared to a dielectric plate incorporating resonators which are substantially linearly aligned in the longitudinal direction.

Next, a band-pass filter according to a sixth embodiment of the present invention is described with reference to FIGS. 10 to 15.

Figure 10:
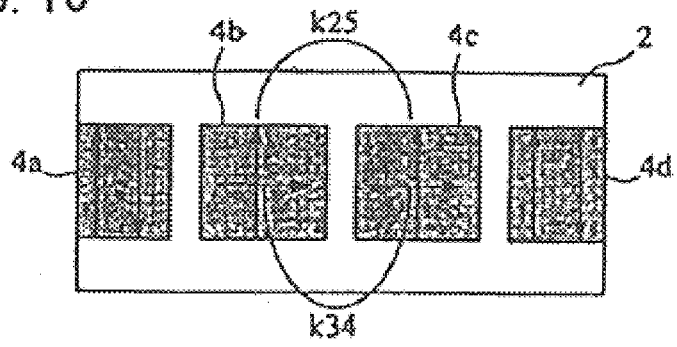
FIG. 10 is a top plan view of a dielectric plate in a band-pass filter according to a sixth embodiment of the present invention.

FIG. 10 is a top plan view of a dielectric plate in the band-pass filter. As shown in FIG. 10, non-electrode portions 4*a* to 4*d* are formed on the upper surface of the dielectric plate, and four non-electrode portions which face the non-electrode portions 4*a* to 4*d* are formed on the lower surface of the dielectric plate, so that the sets of non-electrode portions form resonators. The non-electrode portions 4*b* and 4*c* are substantially square, and the associated resonators are configured so as to resonate in dual modes, that is, a $\lambda/2$ resonance mode in which the electric fields are oriented in the direction along the alignment of adjacent resonators, and a $\lambda/2$ resonance mode in which the electric fields are oriented in the direction orthogonal thereto.

The input- and output-stage resonators of the non-electrode portions 4*a* and 4*d* have the electrodes open at both ends of the dielectric plate, thereby serving as $(3/4)\lambda$ resonators.

The degenerate relation of each dual-mode resonator splits into two resonator stages which are coupled with each other, thereby achieving a band-pass filter including a total of six resonator stages.

Figure 11:
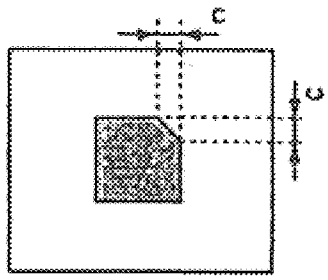
FIG. 11 is a diagram of the structure of a dual-mode resonator which functions as two coupled resonator stages.

FIG. 11 shows an exemplary configuration of a non-electrode portion forming a single dual-mode resonator which is coupled as two resonator stages. As shown in FIG. 11, the electrode is expanded at one comer of the rectangular (square) non-electrode portion by a horizontal and vertical dimension of "c". The resonance frequencies differ between even and odd resonance modes in which the electric fields are vertically and horizontally oriented in FIG. 11, whereby the degenerate relation of the dual-mode resonator splits into two resonator stages which are coupled with each other.

Figure 12A:
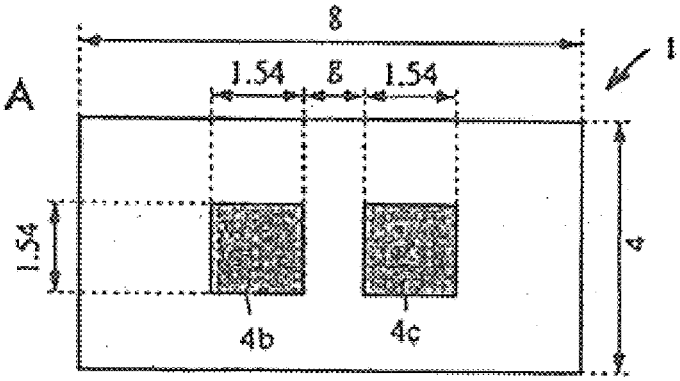
FIGS. 12A and 12B are view showing a position relationship between two adjacent dual-mode resonators.
Figure 12B:
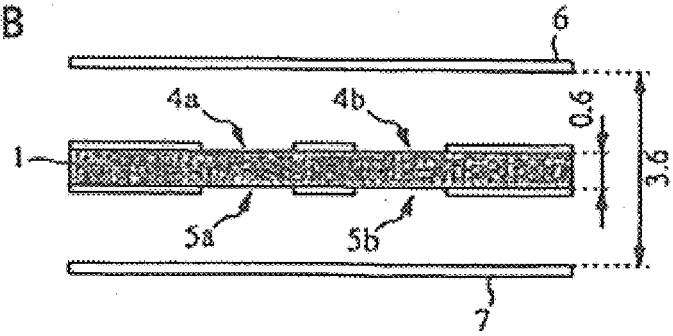
Figure 13:
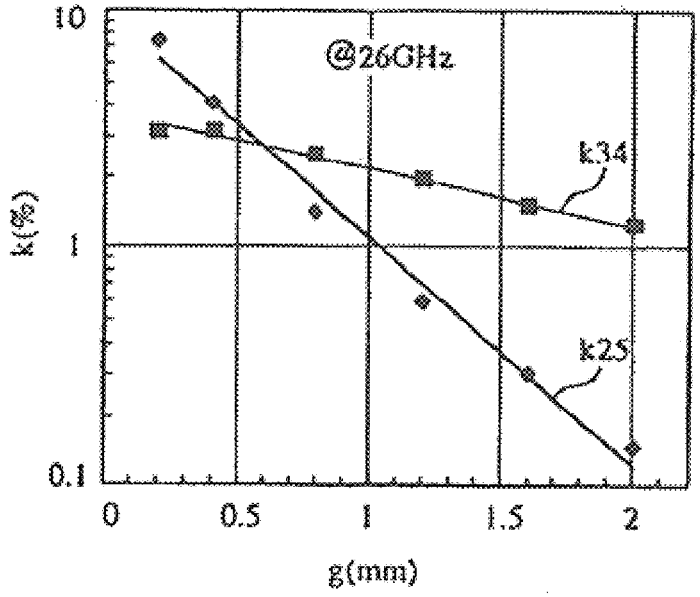
FIG. 13 is a graph showing a change in coupling coefficient k between resonators when gap g varies.

FIGS. 12A and 12B are a top plan view and a cross-sectional view, respectively, of a dielectric plate 1 on which two dual-mode resonators are arranged. FIGS. 10 and 13 show a relationship between electrical (capacitive) coupling and magnetic (inductive) coupling between adjacent resonators. FIG. 12B also shows conductive plates above and beneath the dielectric plate 1. In this example, given a frequency of 26 GHz, with the relative dielectric constant of the dielectric plate 1 being 24, and given the components dimensioned as shown in FIGS. 12A and 12B, when gap g between the dual-mode resonators varies, changes in coupling coefficient k25 between second- and fifth-stage resonators, and coupling coefficient k34 between third- and fourth-stage resonators are shown in FIG. 13. In this way, since the coupling coefficients k25 and k34 can be determined depending upon the gap g, the gap g should be merely determined so that the cross-coupling coefficient between the second- and fifth-stage resonators, and the coupling coefficient between the third- and fourth-stage resonators may have predetermined strengths.

Figure 14:
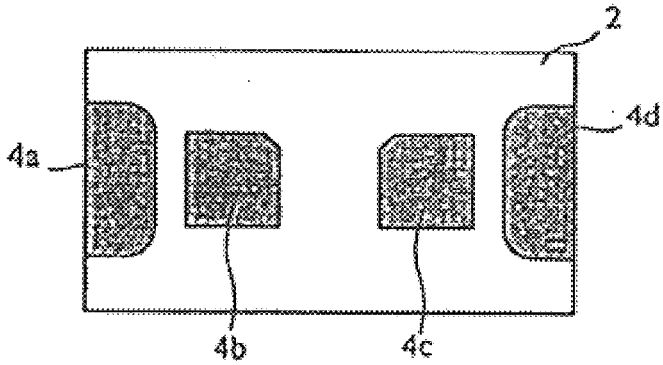
FIG. 14 is a top plan view of a dielectric plate incorporating six resonator stages thereon.
Figure 15:
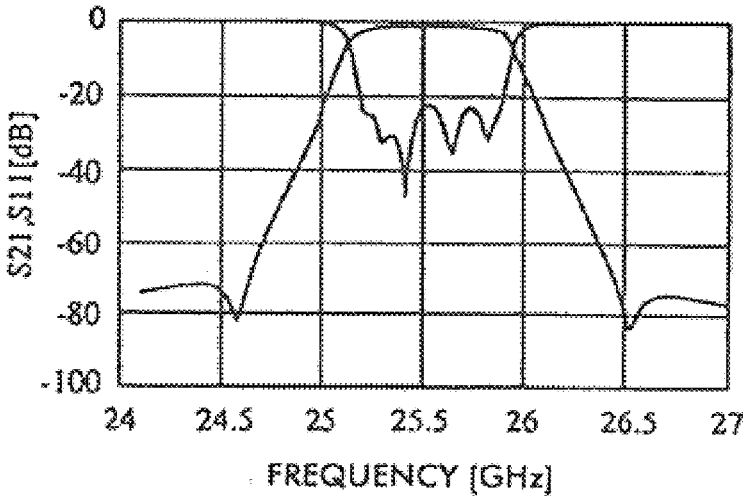
FIG. 15 is a graph showing the frequency characteristic of a band-pass dielectric filter using the dielectric plate shown in FIG. 14.

FIG. 14 shows an exemplary design of input- and output-stage resonators, and second- to fifth-stage resonators, which is used as an application of the dielectric plate having the structure shown in FIG. 10, so that a predetermined filter characteristic can be achieved. FIG. 15 shows the frequency characteristic of FIG. 14. The cross-coupling with two-stage resonators being skipped produces attenuation poles at both high- and low-frequency regions of the pass band. If the dielectric plate has a relative dielectric constant of 24, and a thickness of 0.6 mm, and if the input- and output-stage resonators are $\lambda/4$ resonators, the dielectric plate for use in the 26 GHz band has an overall length of approximately 8 mm, and can thus be reduced to approximately 40% as compared to the dielectric plate incorporating five-stage resonators as shown in FIG. 19.

It is noted that, as shown in FIG. 14, the non-electrode portions 4*a* and 4*d* extend along the width of the dielectric plate, and have the comers rounded, thereby mitigating a current concentration, increasing the Q factor.

Next, a band-pass filter according to a seventh embodiment of the present invention is described with reference to FIG. 16.

Figure 16:
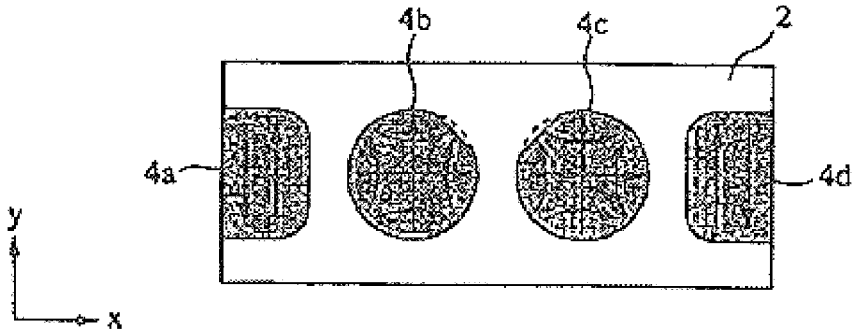
FIG. 16 is a top plan view of a dielectric plate in a band-pass filter according to a seventh embodiment of the present invention.

While the dual-mode resonators are formed of substantially square electrode-free portions in the examples shown in FIGS. 10 to 14, the dual-mode resonators may be formed of substantially circular non-electrode portions, as shown in FIG. 16. In FIG. 16, non-electrode portions 4*b* and 4*c* serve as dual-mode resonators having an HE110x mode where the electric fields are oriented substantially in the x direction, and an HE110y mode where the electric fields are oriented substantially in the y direction, respectively. The electrode 2 is extended into the non-electrode portions 4*b* and 4*c* in two directions which are not parallel to either the x or y direction, thereby making the width of the electrode-free portions narrower in those directions. This splits the degenerate relation of two modes into two two-stage resonators which are then coupled. The input- and output-stage resonators of the electrode-free portions 4*a* and 4*d* serve as $(3/4)\lambda$ resonators which generate the electric fields oriented in the y direction, and are magnetically coupled with the HE110y mode of the dual-mode resonators. A band-pass filter incorporating a total of six resonator stages is therefore constructed and achieved in the same manner as shown in FIG. 14.

A shared transmitting-and-receiving unit according to an eighth embodiment of the present invention is now described with reference to FIG. 17.

Figure 17:
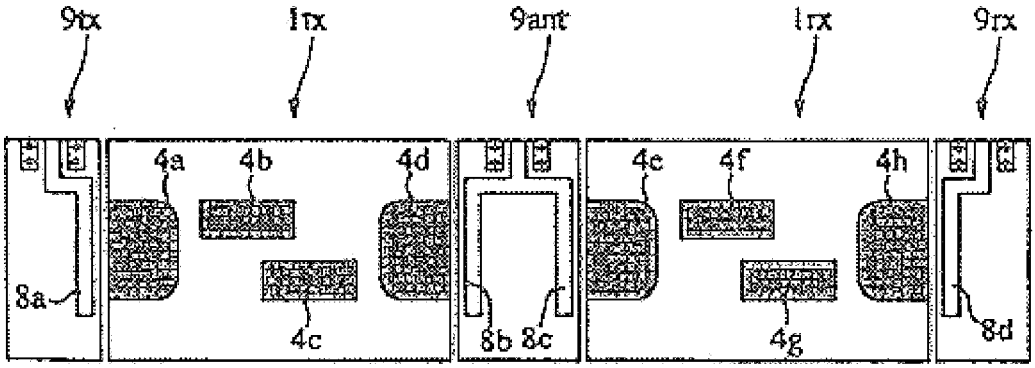
FIG. 17 is a top plan view of a shared transmitting-and-receiving unit according to an eighth embodiment of the present invention, from which an upper conductive plate is removed.

In FIG. 17, the shared transmitting-and-receiving unit includes a dielectric plate 1tx on a transmission filter side, a dielectric plate 1rx on a reception filter side, a transmission signal input substrate 9tx, a received signal output substrate 9rx, and an antenna signal input/output substrate 9ant. The dielectric plate 1tx includes non-electrode portions 4*a* to 4*d*, and the dielectric plate 1rx includes non-electrode portions 4*e* to 4*h*. The dielectric plates 1tx and 1rx further include non-electrode portions on the respective lower surfaces so as to face the non-electrode portions 4*a* to 4*h* and to have the same configuration thereas. On the upper surfaces of the transmission signal input substrate 9tx, the antenna signal input/output substrate 9ant, and the received signal output substrate 9rx, input/output lines 8*a*, 8*b* and 8*c*, and 8*d* are formed as probes, respectively. Ground electrodes are formed substantially entirely on the respective lower surfaces of the substrates 9tx, 9ant, and 9rx. Conductive plates are placed above and beneath the dielectric plates 1tx and 1rx, the substrates 9rx, 9ant, and 9rx at a predetermined spacing. The input/output line 8*a* is coupled with the resonator of the non-electrode portion 4*a*. The input/output lines 8*b* and 8*c* are coupled with the resonators of the electrode-free portions 4*d* and 4*e*, respectively. The input/output line 8*d* is coupled with the resonator of the electrode-free portion 4*h*.

Accordingly, a filter portion formed of the four resonators 4*a* to 4*d* is used as a transmission filter, and the four resonators of the non-electrode portions 4*e* to 4*h* are used as a reception filter. In a system having a transmission frequency band lower than a reception frequency band, the coupling coefficients k12, k23, k34, k13, and k24 are made magnetic (inductive) so that an attenuation pole is produced at a high-frequency region of the pass band for the transmission filter. Furthermore, the coupling coefficients k12 and k34 are made magnetic (inductive), and the coupling coefficient k23 is made electric (capacitive) by determining the d/L value as shown in FIG. 3, so that an attenuation pole is produced at a low-frequency region of the pass band for the reception filter.

This can achieve a reduction in size of the dielectric plates and the input/output substrates, and ensures a great amount of coupling attenuation between the transmitter and the receiver.

Figure 18:
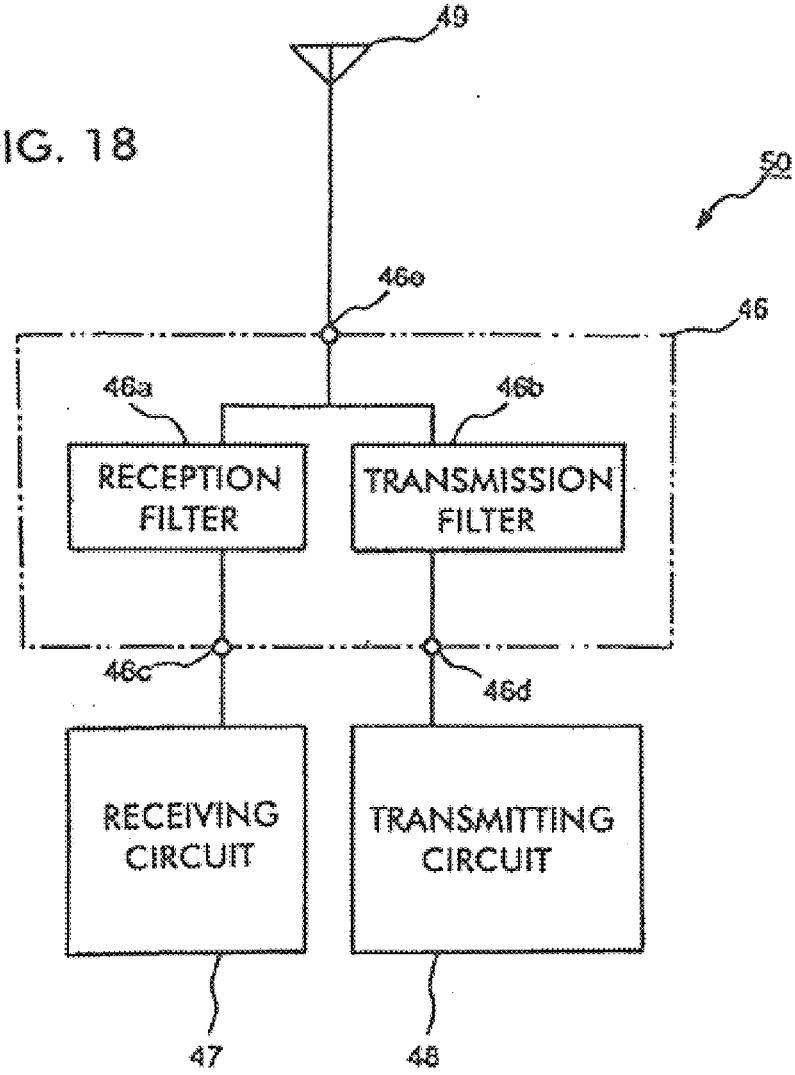
FIG. 18 is a block diagram of a communication apparatus according to a ninth embodiment of the present invention.

FIG. 18 is a block diagram of a communication apparatus 50 which uses the shared transmitting-and-receiving unit as a shared antenna unit. The communication apparatus 50 includes a reception filter 46*a*, and a transmission filter 46*b*, which are combined into a shared antenna unit 46. As shown in FIG. 18, the shared antenna unit 46 has a received signal output port 46*c* connected to a receiving circuit 47, a transmission signal input port 46*d* connected to a transmitting circuit 48, and an antenna port 46*e* connected to an antenna 49.

The shared antenna unit is merely illustrative, and is not intended to be restrictive. A band-pass filter according to the present invention may be incorporated in any RF circuit of the communication apparatus. The compactness, low-loss characteristic, and high selectivity of the band-pass filter can be taken advantage of to form a more compact and lightweight communication apparatus.

Although the present invention has been described in relation to particular embodiments thereof, many other variations and modifications and other uses will become apparent to those skilled in the art. Therefore, the present invention is not limited by the specific disclosure herein.

What is claimed is:

1. A band-pass filter comprising a dielectric filter including:

electrodes formed on both upper and lower surfaces of a substantially rectangular dielectric plate;

a first plurality of substantially rectangular non-electrode portions which are adjacent to each other and formed in the electrode on the upper surface of the dielectric plate; and a second plurality of substantially rectangular non-electrode portions formed in the electrode on the lower surface of the dielectric plate and opposing a respective non-electrode portion of the first plurality of non-electrode portions so as to form a plurality of resonators in regions confined by the opposing non-electrode portions, wherein at least some of the plurality of resonators other than input- and output-stage resonators are $n\lambda/2$ resonators, where $\lambda$ denotes one wavelength and n is an integer more than one, and wherein the plurality of resonators include a first group of adjacent resonators which are capacitively coupled, and a second group of adjacent resonators which are inductively coupled.

2. A band-pass filter according to claim 1, wherein the input- and output-stage resonators are placed at respective ends of the dielectric plate;

the input-stage resonator is capacitively coupled with a resonator adjacent thereto, and the output-stage resonator is capacitively coupled with a resonator adjacent thereto; and the resonators other than the input- and output-stage resonators of the plurality of resonators are inductively coupled with each other.

3. A band-pass filter according to claim 1, wherein longitudinal axes of the plurality of resonators are not aligned in a straight line.

4. A band-pass filter comprising a dielectric filter including:

electrodes formed on both upper and lower surfaces of a substantially rectangular dielectric plate;

a first plurality of substantially rectangular non-electrode portions which are adjacent to each other and formed in the electrode on the upper surface of the dielectric plate; and a second plurality of substantially rectangular non-electrode portions formed in the electrode on the lower surface of the dielectric plate and opposing a respective non-electrode portion of the first plurality of non-electrode portions so as to form a plurality of resonators in regions confined by the opposing non-electrode portions, wherein input- and output-stage resonators of the plurality of resonators are placed at respective ends of the dielectric plate, the input-stage resonator is capacitively coupled with a resonator adjacent thereto, the output-stage resonator is capacitively coupled with a resonator adjacent thereto, and the resonators other than the input- and output-stage resonators of the plurality of resonators are inductively coupled with each other, the resonators other than the input- and output-stage resonators of the plurality of resonators are $\lambda$ resonators, where $\lambda$ denotes one wavelength, the plurality of resonators are arranged so that longitudinal axes of each of the resonators are parallel to each other rather than linearly aligned, and the resonators other than the input- and output-stage resonators of the plurality of resonators are inductively coupled with each other when d/L is smaller than approximately 0.67, where L denotes a length of the longitudinal axes of a resonator, and d denotes a length of facing portions of adjacent resonators.

5. A shared transmitting-and-receiving unit comprising:

a transmission filter and a reception filter, each of the transmission filter and the reception filter comprising a band-pass filter which includes:

electrodes formed on both upper and lower surfaces of a substantially rectangular dielectric plate;

a first plurality of substantially rectangular non-electrode portions which are adjacent to each other and formed in the electrode on the upper surface of the dielectric plate; and a second plurality of substantially rectangular non-electrode portions formed in the electrode on the lower surface of the dielectric plate and opposing a respective non-electrode portion of the first plurality of non-electrode portions so as to form a plurality of resonators in regions confined by the opposing non-electrode portions, wherein at least some of the plurality of resonators other than input- and output-stage resonators are $n\lambda/2$ resonators, where $\lambda$ denotes one wavelength and n is an integer more than one, and wherein the plurality of resonators include a first group of adjacent resonators which are capacitively coupled and a second group of adjacent resonators which are inductively coupled.

6. A communication apparatus comprising at least one of a transmitting circuit and a receiving circuit, said at least one circuit comprising a band-pass filter which includes:

electrodes formed on both upper and lower surfaces of a substantially rectangular dielectric plate;

a first plurality of substantially rectangular non-electrode portions which are adjacent to each other and formed in the electrode on the upper surface of the dielectric plate; and a second plurality of substantially rectangular non-electrode portions formed in the electrode on the lower surface of the dielectric plate and opposing a respective non-electrode portion of the first plurality of non-electrode portions so as to form a plurality of resonators in regions confined by the opposing non-electrode portions, wherein at least some of the plurality of resonators other than input- and output-stage resonators are $n\lambda/2$ resonators, where $\lambda$ denotes one wavelength and n is an integer more than one, and wherein the plurality of resonators include a first group of adjacent resonators which are capacitively coupled and a second group of adjacent resonators which are inductively coupled.

* * * * *

UNITED STATES PATENT AND TRADEMARK OFFICE

CERTIFICATE OF CORRECTION

PATENT NO. : 6,809,615 B2
DATED : October 26, 2004
INVENTOR(S) : Tomiya Sonoda et al.

It is certified that error appears in the above-identified patent and that said Letters Patent is hereby corrected as shown below:

Title page,
Item [56], References Cited, FOREIGN PATENT DOCUMENTS, please delete "JP 2000-340171, 12/2000" and insert -- JP 2000-341071, 12/2000 --

Signed and Sealed this

Nineteenth Day of April, 2005

JON W. DUDAS
*Director of the United States Patent and Trademark Office*